United States Patent [19]

Gallen

[11] 4,337,895

[45] Jul. 6, 1982

[54] HIGH SPEED ROTARY ATOMIZERS

[76] Inventor: Thomas Gallen, 1516 Buck Rd., Feasterville, Pa. 19047

[21] Appl. No.: 130,787

[22] Filed: Mar. 17, 1980

[51] Int. Cl.[3] ..... B05B 3/04; B05B 7/00; B05B 1/06

[52] U.S. Cl. ..... 239/7; 239/8; 239/214.13; 239/223; 239/DIG. 1

[58] Field of Search ..... 239/7, 8, 214.11–214.17, 239/214.25, 223, 224, 700, 703, DIG. 1

[56] References Cited

FOREIGN PATENT DOCUMENTS 473096 10/1937 United Kingdom ..... 239/214.17

819643 9/1959 United Kingdom ..... 239/214.25

*Primary Examiner*—Andres Kashnikow

*Attorney, Agent, or Firm*—Leo C. Krazinski

[57] ABSTRACT

An improved fluid supply head for high speed rotary atomizers in which high velocity low volume air is introduced directly into the spindle shaft and sealing recesses of the head downstream of bearings supporting the shaft and exhausted along the spindle shaft and along the inner periphery of the atomizing disc. This high velocity low volume air, as it emerges at the disc, creates a venturi-like action that draws the spraying fluid towards the center of the disc axis to form an improved doughnut-shaped spray pattern. This high velocity low volume air also fluid seals the bearings.

6 Claims, 6 Drawing Figures

HIGH SPEED ROTARY ATOMIZERS

BACKGROUND OF THE INVENTION

1. Field of the Invention

The present invention relates to a method and apparatus for spray coating articles of manufacture and, in particular, to improve the doughnut-shaped spray pattern of the atomizer.

2. Description of Prior Art

Heretofore, probes have been used for improving the doughnut-shaped spray pattern, as disclosed in U.S. Pat. No. 2,989,241. In conventional high speed rotary atomizers two sources of air are introduced, a first source for rotating the air vane and a second source for enveloping the paint to produce the spray pattern. The first source of air after exhausting from the air vane merges with the second source of air in the sleeve of the atomizer, so that both sources of air envelope the paint. In such conventional high speed rotary atomizers it has been found that some of the paint and solvent introduced into the atomizer tend to run back from the disc along the spindle shaft and thereby ruin the bearings. Furthermore, the air passing out of the sleeve and around the outer periphery of the disc in enveloping the paint particles produces a doughnut-shaped spray pattern in which the hole thereof is exceedingly large and the body relatively small.

SUMMARY OF THE INVENTION

Accordingly, an object of the invention is to provide an improved method and apparatus for spray coating articles of manufacture.

Another object is to provide in a high speed rotary atomizer a discharge of air along an inner peripheral surface of a disc.

Still another object is to provide a high speed rotary atomizer that produces a doughnut-shaped pattern in which the hole thereof is much smaller than in conventional practice.

Yet another object is to provide a high speed rotary atomizer in which during a paint spraying operation the paint and solvent particles are prevented from flowing back along the spindle shaft and bearings thereof.

A further object is to provide a high speed rotary atomizer having improved coating dispersion, increased efficiency in tailoring the overall pattern diameter to conform to part size, and increased flexibility in coating parts with recesses.

Other and further objects will be obvious upon an understanding of the illustrative embodiment about to be described, or will be indicated in the appended claims and various advantages not referred to herein will occur to one skilled in the art upon employment of the invention.

In accordance with the present invention, the foregoing objects are generally accomplished by directing high velocity low volume air into the spindle shaft recess and sealing recess of the spindle shaft into the disc for venturi action with the particles of paint fluid flowing out of the fluid head, thereby assuring a vast improvement in the doughnut-shaped spray pattern. This high velocity low volume air supply replaces the prior art air that had been passed within the atomizer shield and exhausted outwardly of the disc for enveloping the paint particles.

Important features and advantages of the present invention are:

1. Spray pattern using similar type head produces doughnut-shaped pattern and by introducing high velocity low volume air into and through the disc tends to venturi paint particles around the hole in the doughnut-shaped pattern pulling the particles toward the center of the hole, thus reducing the hole size. 2. Increases efficiency by reducing overall pattern size of atomized paint to conform more to size of target part in spray area.

3. When two or more atomizers are on spray console, makes it easier to adjust and direct pattern to cover different areas of target.

4. Controlled forward thrust of high velocity low volume air increases penetration of paint particles into the recesses of odd shaped target parts.

5. Aids in protecting shaft bearings from getting paint and or solvent backing down the shaft from the disc, which then ruins the bearings.

BRIEF DESCRIPTION OF THE DRAWINGS

A preferred embodiment of the invention has been chosen for purposes of illustration and description and is shown in the accompanying drawings, forming a part of the specification, wherein.

Figure 1:
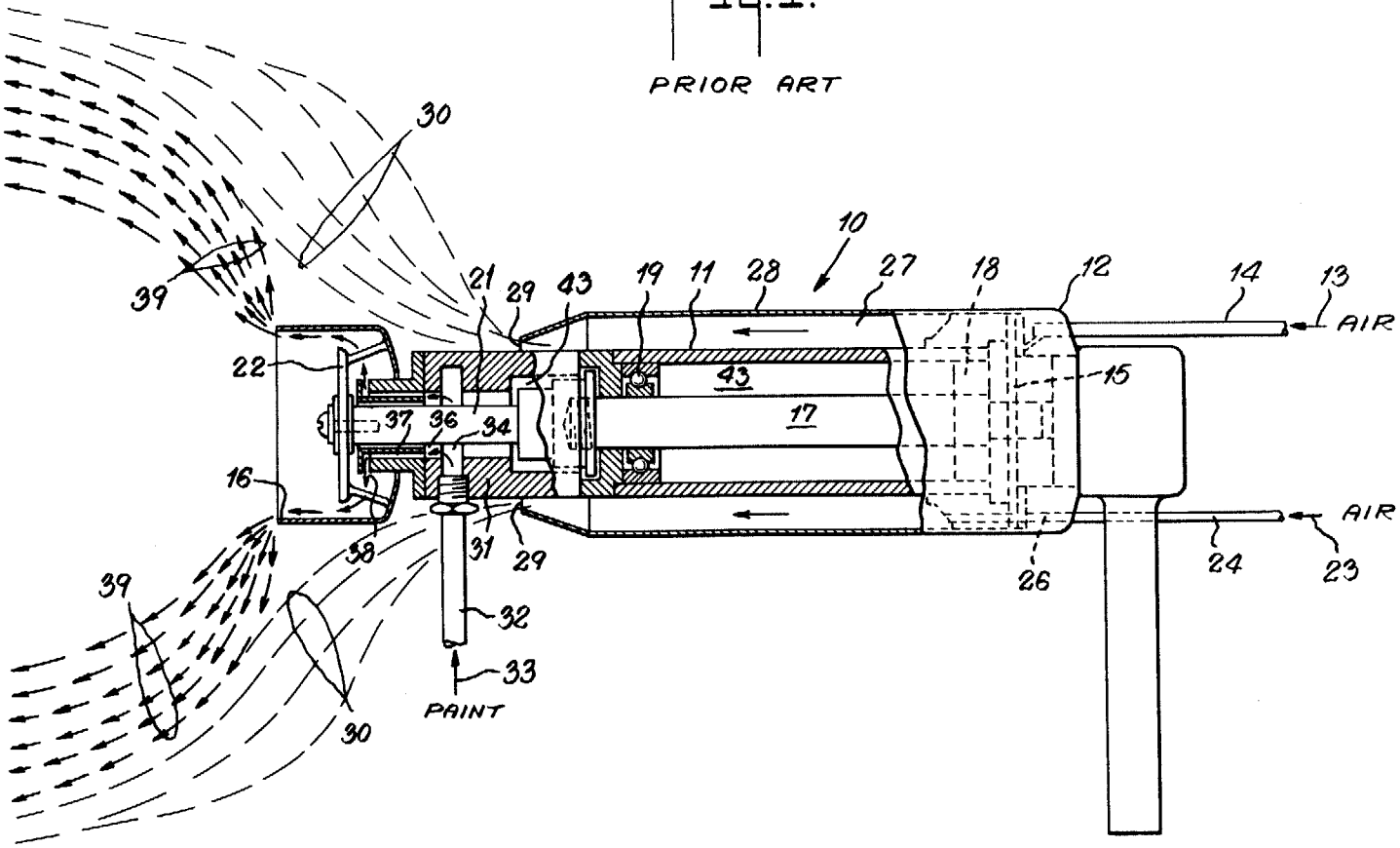
Fig. 1. PRIOR ART
FIG. 1 is a combined sectional and schematic view of a prior art high speed rotary atomizer showing the paths taken by sleeve and vane air inputs and paint input, as well as the resulting pattern of exiting air enveloping the paint particles.
Figure 4:
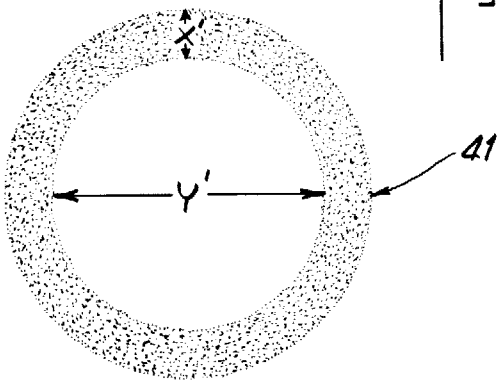
FIG. 4 is a similar view of a doughnut-shaped paint spray pattern produced by a rotary atomizer of the prior art wherein the air path is via the sleeve, as in FIG. 1.
Figure 3:
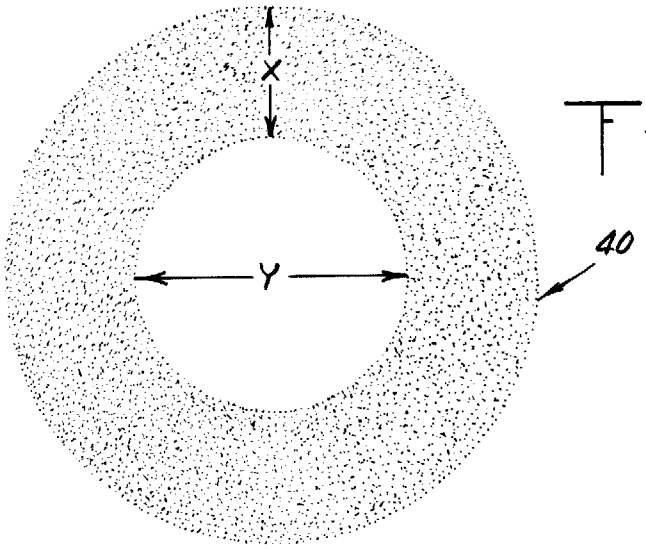
FIG. 3 is a diagrammatic view of a doughnut-shaped paint spray pattern produced by a rotary atomizer of the prior art.

Referring to the drawings in detail, particularly to FIGS. 1, 3 and 4, there is shown a high speed rotary atomizer 10 of the prior art, which includes a body 11 housing a back plate 12 into which air 13 is introduced through a tube 14 for revolving a vane 15 and, in turn, a disc 16 via shaft 17 rotatable in rear bearing 18 and front bearing 19, spindle shaft extension 21 rigidly secured to shaft 17, and hub 22 of the disc 16 rigidly secured to the spindle shaft extension 21. A separate source of air 23 is also introduced into the body 11 through a tube 24, passage 26 in the back plate 12, thence through a longitudinal annular cavity 27 formed between a cover 28 and the body 11. It might be noted at this point that the air 13 after passing through the vane 15 exhausts into the cavity 27 where it merges with the air 23, both of which exit from opening 29 as air 30.

Adjacent the cavity exit opening 29 and attached to a head 31 of the atomizer 10 is shown a tube 32 through which is introduced a fluid, such as paint 33, that enters the head 31 at annular opening 34, passes successively through channels 36, 37, and 38 and thence along the inner periphery of the rotating disc 16 as atomized paint particles 39. It will be seen that the air 30 envelopes and compresses the paint particles 39 toward the central axis of the atomizer body 11 to form doughnut-shaped patterns 40 and 41, as shown in FIGS. 3 and 4, respectively, where the central openings Y and Y' are quite large and the bodies X and X' of the paint pattern are comparatively small. It has been found that the air 30 in enveloping and compression the paint particles 39 has a tendency to force some of the paint particles back through the clearance space 43 between the shaft 17 and the body 11 where these paint particles settle upon the bearings 18 and 19, with obvious impairment thereof.

Figure 2:
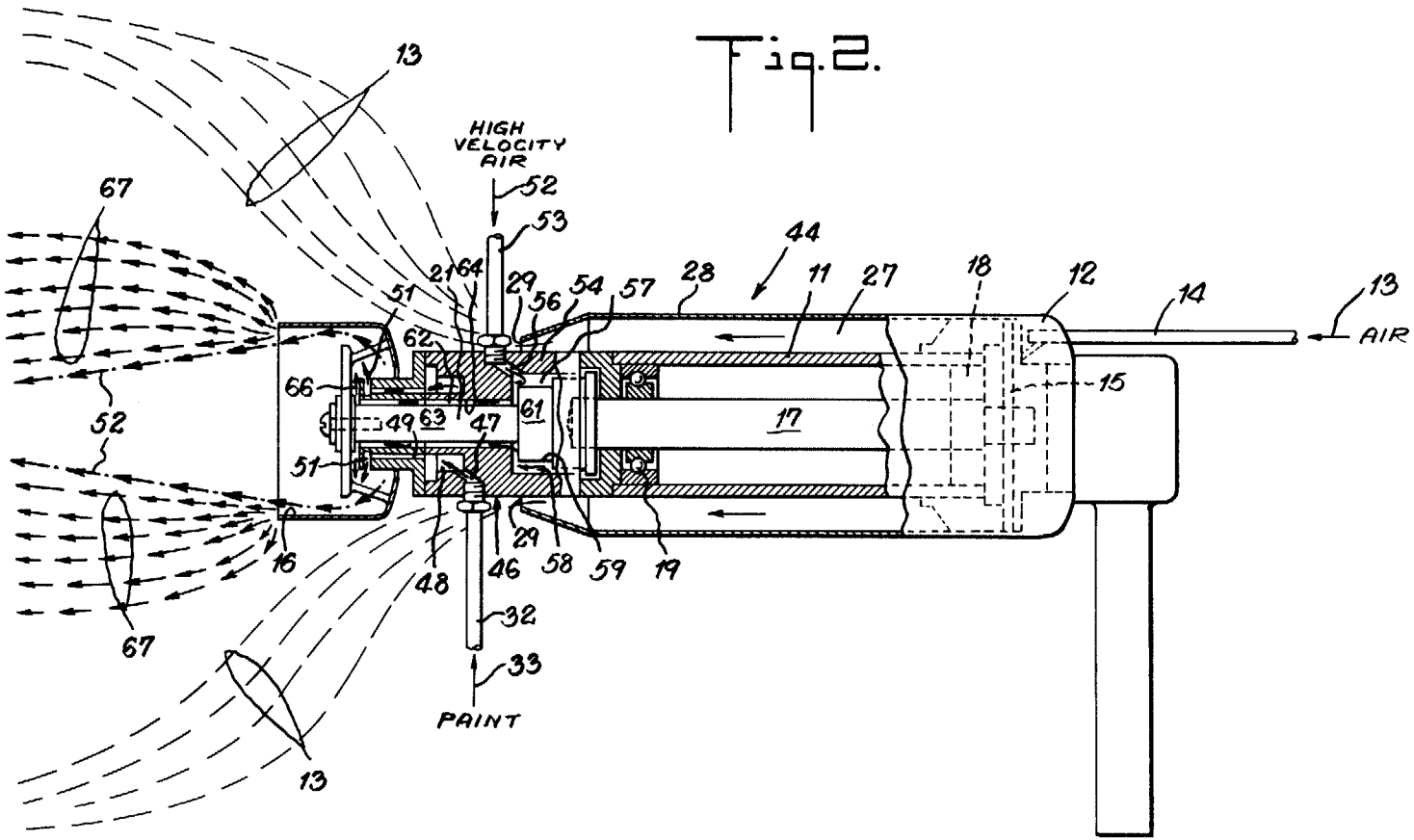
FIG. 2 is a similar combined sectional and schematic view of a high speed rotary atomizer showing the paths taken by the head and vane air inputs and paint input, as well as the resulting pattern of exiting air venturying the paint particles.
Figure 6:
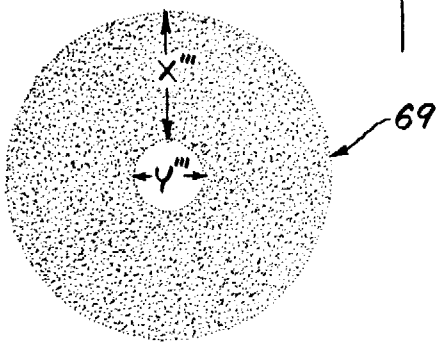
FIG. 6 is a view of a doughnut-shaped paint spray pattern produced by the rotary atomizer of FIG. 2 using air of a higher velocity and pressure than that in FIG. 5.
Figure 5:
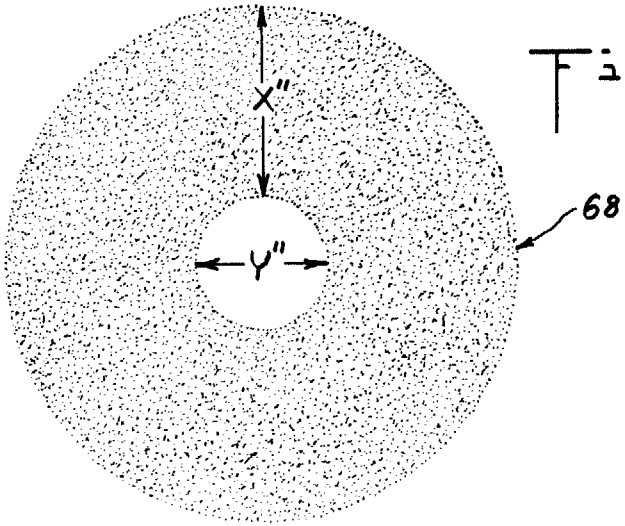
FIG. 5 is a view of a doughnut-shaped paint spray pattern produced by a high speed rotary atomizer shown in FIG. 2.

Referring now to FIGS. 2, 5 and 6, there is shown applicant's improved high speed rotary atomizer 44 over the atomizer 10 of the prior art shown in FIG. 1. Essentially the construction of both atomizers 10 and 44 is substantially the same, except for the head portion, in that the air 13, while it rotates the vane 15 and exhausts into the cavity 27 as before indicated, it passes out through the opening 29 as air 13 per se. It is to be noted that the air 23 of FIG. 1 has been eliminated. Similarly, the paint 33 is passed through the tube 32, secured to a modified head 46, and through channels 47, 48, 49 and 51, and is discharged at the inner periphery of the rotary disc 16.

The improvement herein resides specifically in passing a high velocity low volume air 52 through a tube 53, which is secured to an element 54 of the modified head 46, through a channel 56 into a recess 57, which is between an inner surface 58 of the element 54 and an outer surface 59 of a base 61 of the spindle shaft extension 21, then longitudinally along a space 62 between a stem 63 of the spindle shaft extension 21 and a cylindrical wall 64 of the modified head 46, and finally via channel 66 onto the inner peripheral surface of the disc 16. It is to be noted that the air channel 66 exit lies to the left of the paint channel 51 exit, as viewed in FIG. 2, so that the high velocity low volume air 52 will be positioned nearest to the axis of the atomizer 44 and surrounded by the atomized paint particles 67. As so positioned, the high velocity low volume air 52 draws the paint particles toward itself and towards the axis of the disc 16; in other words, the air 52 tends to venturi the paint particles 67 and thereby create, as shown in FIG. 5, a doughnut-shaped spray paint pattern 68 having a hole Y'' much smaller than the hole Y' and a band width X'' much greater than the band width X' of the prior art, as seen in FIG. 3. By increasing the air velocity it is possible to create yet a smaller hole Y''' and a band width X''' of the same size, as indicated in FIG. 6, with a smaller doughnut-shaped spray pattern 69. It has been found that at a pressure of 10–20 lbs./sq.in. the high velocity low volume air 52 entering the disc 16 around the clearance space 62 of the spindle shaft extension 21 and channel 66 tends to give controlled forward thrust of atomized paint from 2" to 3" and from 8" to 10" upon pressure increase of 40–50 lbs./sq.in.

From the foregoing description, it will be seen that the present invention provides an efficient paint spray coating system in the formation of the doughnut-shaped spray pattern by directing high velocity low volume air into the spindle shaft recess and sealing recess of the atomizer for the air to follow along the spindle shaft without loss onto the inner peripheral surface of the disc for venturi action with the atomized paint particles flowing out of the atomizer head. This high velocity low volume air replaces the prior art air that had been directed outwardly of the disc surface for enveloping the paint particles.

As various changes may be made in the form, construction and arrangement of the parts herein, without departing from the spirit and scope of the invention and without sacrificing any of its advantages, it is to be understood that all matters are to be interpreted as illustrative and not in any limiting sense.

What is claimed is:

1. In a high speed rotary atomizer having a vane rotated by air which vane in turn rotates a shaft carried upon bearings and which shaft includes a spindle extension for rotating a disc, the method of spray painting which consists in passing a second source of air and atomizing particles of spray material upon the inner peripheral surface of said rotating disc, wherein said second source of air is introduced downstream of said bearings for fluid sealing said bearings from said paint particles and, whereby the paint particles are drawn by the second source of air inwardly toward the axis of the disc to produce an improved doughnut-shaped spray pattern.

2. The method of claim 1, wherein the second source of air is restricted to entrance at and discharge from a head of the atomizer.

3. The method of claim 2, wherein the second source of air is introduced into a recess between the base of a spindle shaft extension and a body of the head, passed longitudinally along a stem of said shaft extension, and thence through a channel in said head to the inner peripheral surface of said disc.

4. The method of claim 3, wherein the second source of air is of high velocity and low volume and the spray material is of paint.

5. In a high speed rotary atomizer of the type wherein air rotates a vane rigidly coupled to a shaft carried upon bearings and which shaft includes a spindle extension for rotating a disc at a head of the atomizer, wherein a second source of air is introduced downstream of the bearings and at the head and wherein spray material is discharged upon the inner peripheral surface of the disc to form atomized particles of spray material, the combination of means including a base on said spindle shaft extension, a stem of said spindle shaft extension rigidly coupled to said disc, a recess formed between said base and a body of said atomizer, a clearance along the stem, a channel between said clearance and the interior of said disc for discharging said second source of air into said recess, passing the second source of air along said stem clearance and channel upon the inner peripheral surface of the disc, for producing a venturi action upon the atomized spray material, whereby the second source of air draws the spray material inwardly toward the axis of the disc to produce an improved doughnut-shaped spray pattern, and for providing a fluid seal for said bearings, whereby said spray material is prevented from impairing said bearings.

6. In a high speed rotary atomizer according to claim 5, wherein the second source of air is of high velocity and low volume and the spray material is of paint.

* * * * *